US010124870B2

(12) United States Patent
Bergmann et al.

(10) Patent No.: US 10,124,870 B2
(45) Date of Patent: Nov. 13, 2018

(54) ELECTRIC BOAT DRIVE

(71) Applicant: Torqeedo GmbH, Gilching (DE)

(72) Inventors: Lothar Bergmann, Gilching (DE); Frank Despineux, Gilching (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 15/594,180

(22) Filed: May 12, 2017

(65) Prior Publication Data

US 2017/0327197 A1 Nov. 16, 2017

(30) Foreign Application Priority Data

May 13, 2016 (EP) ..... 16001099

(51) Int. Cl.
*B63H 20/12* (2006.01)
*B63H 21/17* (2006.01)

(52) U.S. Cl.
CPC ..... *B63H 20/12* (2013.01); *B63H 21/17* (2013.01)

(58) Field of Classification Search
CPC ..... B63H 20/10; B63H 20/20; B63H 21/17; B63H 21/21; B63H 21/213; B63H 20/12; B63H 20/00; B63H 20/08
USPC ..... 440/1, 6, 55
See application file for complete search history.

(56) References Cited

U.S. PATENT DOCUMENTS 7,594,833 B2 * 9/2009 Oishi ..... B63H 20/10 440/1
2010/0048068 A1 2/2010 Bamba

FOREIGN PATENT DOCUMENTS

| | | | |
|---|---|---|---|
| EP | 1 961 656 | B1 | 12/2011 |
| JP | 62-129397 | U | 8/1987 |
| JP | 2009-234514 | A | 10/2009 |
| JP | 2011-213241 | A | 10/2011 |
| JP | 2013-39887 | A | 2/2013 |
| JP | 2013-39888 | A | 2/2013 |
| JP | 2014-46745 | A | 3/2014 |
| JP | 2014-172518 | A | 9/2014 |

OTHER PUBLICATIONS

Japanese Office Action issued in Japanese counterpart application No. 2017-096257 dated Jul. 3, 2018, with English translation (Ten (10) pages).

* cited by examiner

*Primary Examiner* — Lars A Olson
(74) *Attorney, Agent, or Firm* — Crowell & Moring LLP

(57) ABSTRACT

A boat drive includes an electric motor that drives a propeller to rotate; a user-actuated unlocking device; and a user-actuated control device configured to control the electric motor. The control device has a neutral position and at least one operating position. The control device and the unlocking device are configured to enable the electric motor to drive the propeller only when both the unlocking device is actuated and the control device is simultaneously in the at least one operating position.

17 Claims, 1 Drawing Sheet

ELECTRIC BOAT DRIVE

This application claims the priority of European Patent Document No. EP 16 001 099.7, filed May 13, 2016, the disclosure of which is expressly incorporated by reference herein.

BACKGROUND AND SUMMARY OF THE INVENTION

The disclosure relates to a boat drive with an electric motor which drives a propeller, and with a control device for controlling the electric motor, wherein the control device can be brought to a neutral position in which the propeller is not driven, and wherein the control device can be brought to at least one operating position in which the propeller is rotated.

Outboard motors for boats are often controlled by means of a tiller attached to the outboard motor. The speed of rotation is usually varied by turning the twist grip on the tiller. In combustion motors, the transmission of force from the motor to the propeller is interrupted at idle, usually by means of a centrifugal clutch. This is necessary in order that the propeller does not immediately begin to rotate, and thereby drive the boat, when the motor starts. Only when the motor's rotational speed is increased by turning the throttle grip is the force from the motor transmitted to the propeller and the boat driven by the rotation of the propeller.

Because combustion motors can rotate in only one direction, the direction of rotation of the propeller must be changed by means of a reversing transmission. Using a shift lever, the propeller can be switched back and forth between its two directions of rotation. Thus the propeller can rotate forwards in one position of the shift lever, and in reverse in the other position of the shift lever, without the need for the combustion motor to change its direction of rotation to achieve this. To change the propeller's direction of rotation, it is only necessary to throttle back and then, when the motor is at idle, change the position of the shift lever of the reversing transmission.

In the case of an outboard motor with an electric drive, the selector switch for forward and reverse gears can be dispensed with. The propeller's direction of rotation can be governed by the direction of the current. An idle mode and a centrifugal clutch are also unnecessary, since when the propeller is not in motion the electric motor is also at a standstill. This also means, however, that if the throttle is unintentionally opened, the propeller begins to rotate unless a further safety device is provided.

Electric motors deliver high torque even at low rotational speeds. Particularly in the case of high-performance electric outboard motors, there is a risk that inadvertent twisting of the throttle grip will set the boat in uncontrolled motion.

An object of the present invention is therefore to improve an electric boat drive such that unintended opening of the throttle is prevented.

Other features and advantages will become apparent from the following more detailed description, taken in conjunction with the accompanying drawings, which illustrate, by way of example, the principles of the presently described embodiments.

DETAILED DESCRIPTION OF THE DRAWINGS

Figure 2:
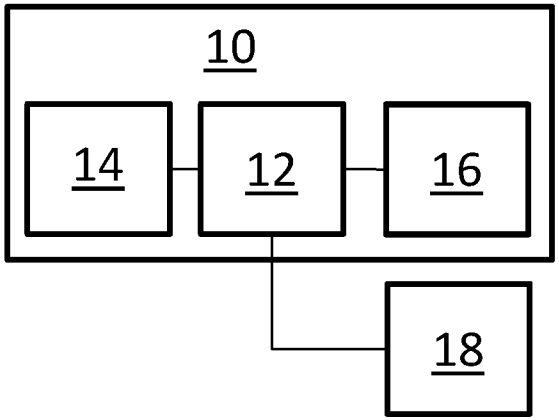
FIG. 2 schematically illustrates an electric boat drive according to at least one embodiment.

The above described drawing figures illustrate the described invention in at least one embodiment, which is further defined in detail in the following description. Those having ordinary skill in the art may be able to make alterations and modifications to what is described herein without departing from its spirit and scope. While the disclosure is susceptible of embodiment in many different forms, there is shown in the drawings and will herein be described in detail at least one embodiment of the invention with the understanding that the present disclosure is to be considered as an exemplification of the principles of the invention and is not intended to limit the broad aspect of the disclosure to the embodiment illustrated. Therefore, it should be understood that what is illustrated is set forth only for the purposes of example and should not be taken as a limitation on the scope of the present disclosure.

Figure 1:
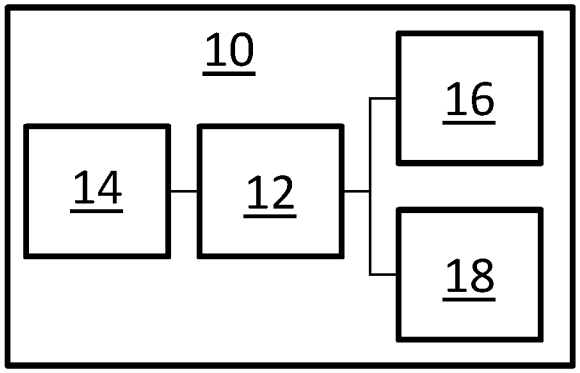
FIG. 1 schematically illustrates an electric boat drive according to at least one embodiment.

Referring to FIGS. 1-2, a boat drive 10 according to at least one embodiment includes an electric motor 12 which drives a propeller 14. To control the electric motor 12, a control device 16 is provided, which can be brought to a neutral position and to at least one operating position. In the neutral position of the control device 16, the propeller 14 is not driven, i.e. the propeller 14 does not rotate. If, on the other hand, the control device 16 is in the operating position, the propeller 14 is rotated by the electric motor 12. According to the invention, an unlocking device 18 is provided which ensures that the propeller 14 only begins to rotate if the unlocking device 18 is operated and at the same time the control device 16 is in the operating position.

Thus according to at least one embodiment, it is necessary to perform two actions that are independent of each other: the control device 16 must be brought out of the neutral position into the operating position, and the unlocking device 18 must be operated. If only one of these two actions is performed, the propeller 14 is not caused to rotate. This prevents the boat from being unintentionally set in motion. This can be achieved, for example, in that it is only possible to bring the control device 16 to the operating position if the unlocking device 18 has previously been operated, or in that the control device 16 remains ineffective if the unlocking device 18 has not been operated in direct conjunction with the control device 16.

In at least one embodiment, the control device 16 possesses, along with the neutral position, a first operating position and a second operating position. In the first operating position, the propeller 14 is rotated in a first direction, and in the second operating position the propeller 14 is rotated in the opposite direction (hereinafter also referred to as the "second direction"). By means of the selection of the operating position of the control device 16, the propeller 14 is rotated in one or the other direction, enabling the selection of either forward or reverse travel.

The terms "neutral position", "first operating position" and "second operating position", along with any further positions, are to be understood as general designations of different operating modes of the control device 16. These operating modes or positions can be set by mechanical adjustment of the control device 16 or a part of the control device 16, for example by moving a control lever or turning a twist grip. It is however also possible to bring the control device 16 to the desired operating mode by other means. In general, a signal is transmitted to the control device 16 and this has an effect on the operating mode. As well as the mechanical interaction with the control device 16 described above, this can occur for example electrically, electronically, by radio transmission, by means of Bluetooth, or by other forms of wireless transmission. The terms "operating position" and "operating mode" will hereinafter be used interchangeably.

In one embodiment, the boat drive 10 comprises a tiller, and the control device 16 is provided on the tiller.

To change from the neutral position to the operating position, it is necessary according to the invention to perform two actions that are independent of each other: the control device 16 must be brought into the operating position and in addition the unlocking device 18 must be operated. It has been found that in this manner the boat can be prevented from being unintentionally set in motion. The control device 16 and the unlocking device 18 can be, but do not have to be, spaced apart from each other. It is for example possible to dispose the control device 16 such that it can be operated by hand, while the unlocking device 18 is operated by a foot control, or the control device 16 is operated by a foot control and the unlocking device by hand. In another embodiment, the unlocking device 18 is provided on the tiller, preferably together with the control device 16. It has been found that no reduction in safety is associated with the operation of both the control device 16 and the unlocking device 18 with the same hand, and this provides a significant increase in ease of operation for the boat's driver. This is therefore regarded as preferred.

For reasons of ease of operation, it has also been found advantageous to design the control device 16 as a hand throttle lever or twist grip.

In this case, in at least one embodiment, the twist grip is brought from the initial neutral position into the operating position by being turned, wherein by turning the twist grip in a first direction the propeller 14 is rotated in a first direction. For example, by turning the twist grip clockwise, forward movement of the boat can be started.

It is advantageous further to design the twist grip such that by turning the twist grip in the opposite, second direction the propeller 14 is rotated in the opposite, second direction. In the above example, turning the twist grip anti-clockwise would thus set the boat in reverse motion.

In at least one embodiment, the control device 16 locks in the neutral position. This represents an additional safety feature, since the control device 16 must be actively brought from the neutral position into the operating position, and cannot slip by accident into the operating position. If in this case the control device 16 is designed as a twist grip, it is advantageously configured such that, in the neutral position, the part of the twist grip that can be turned is locked in the fixed part of the twist grip in a form-fit, force-locking or substance-to-substance manner.

According to at least one embodiment, in order to set the propeller 14 in rotation, the control device 16 must be brought from the neutral position into the operating position, and at the same time the unlocking device 18 must be operated. This protection against inadvertently setting the boat in motion can be designed such that the control device 16 can only be moved out of the neutral position if, simultaneously or in advance, the unlocking device 18 is or has been operated also. For example the control device 16 can only be moved out of the lock in the neutral position if a mechanical unlocking device 18 is operated, for example by pressing a mechanical release button or displacing a release slider. The unlocking device 18 can be designed mechanically, as described above by way of example. An electronic unlocking device 18 can, however, also be provided. Thus the unlocking can take place, for example, by operating an electrical switch or a contact sensor.

In at least one embodiment, the control device 16 can also be brought out of the neutral position into the operating position without operation of the unlocking device 18, but the propeller 14 is only set in rotary motion when the unlocking device 18 is also operated. If this is not done, the movement of the control device 16 into the operating position has no effect.

It is essential that the boat driver does not unintentionally operate the throttle and cause the propeller 14 to rotate. For this purpose, as described, two independent actions are required, namely the operation of both the control device 16 and the unlocking device 18. After the propeller 14 has been intentionally set in motion, it is no longer essential for safety reasons to continue to operate the control device 16 and the unlocking device 18 together. Hence in an embodiment the control device 16 and/or the unlocking device 18 are designed such that, after the control device 16 has been brought into the operating position, it holds the unlocking device 18 mechanically in the unlocked position.

In at least one embodiment, the operation of the unlocking device 18 must continue only until the control device 16 has been brought into the operating position. In a further variant, a timing element is provided, which requires the simultaneous operation of the control device 16 and the unlocking device 18 for a certain period in order to set the propeller 14 in rotation and maintain the rotary movement. After this period it is no longer necessary to continue to operate the unlocking device 18. In order to maintain the rotation of the propeller 14 it is necessary only to hold the control device 16 in the applicable operating position.

In at least one embodiment, when the direction of rotation of the propeller 14 is changed the control device 16 passes through the neutral position. In order then to start rotation in the other direction the simultaneous operation of the unlocking device 18 and the control device 16 is again necessary.

At least one embodiment is particularly suitable for a boat drive which is designed as an electric outboard motor.

The initial problem described above, namely inadvertently starting the rotation of the propeller 14, poses a safety risk above all in the case of high-performance drives. At least one embodiment is thus particularly advantageous when the boat drive 10 has an output of more than 4 kW, more than 6 kW or more than 8 kW.

The enablements described in detail above are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the claimed subject matter is what is intended to be patented.

What is claimed is:

1. A boat drive, comprising:

an electric motor that drives a propeller to rotate;

a user-actuated unlocking device; and a user-actuated control device configured to control the electric motor, the control device having a neutral position and at least one operating position, wherein the control device and the unlocking device are configured to enable the electric motor to drive the propeller only when both the unlocking device is actuated and the control device is simultaneously in the at least one operating position;

wherein the control device is configured to be brought from the neutral position into the operating position, by which the electric motor is enabled to drive the propeller, only if at the same time the unlocking device is actuated.

2. The boat drive of claim 1, wherein the control device has a first operating position in which the propeller is rotated in a first direction, and the control device has a second operating position in which the propeller is rotated in a second direction opposite to the first direction.

3. The boat drive of claim 1, wherein the control device is on a tiller.

4. The boat drive of claim 3, wherein the unlocking device is on the tiller.

5. The boat drive of claim 1, wherein the control device is a hand throttle lever or twist grip.

6. The boat drive of claim 5, wherein the twist grip can be brought from the initial neutral position into the at least one operating position by being turned, and wherein by turning the twist grip in a first direction the propeller is rotated in a first direction.

7. The boat drive of claim 6, wherein by turning the twist grip in the opposite, second direction the propeller is rotated in a second direction opposite to the first direction.

8. The boat drive of claim 1, wherein the control device locks in the neutral position.

9. The boat drive of claim 1, wherein the control device, after being brought into the operating position, holds the unlocking device in the unlocked position.

10. The boat drive of claim 1, wherein the boat drive is an outboard motor.

11. The boat drive of claim 1, wherein the boat drive has an output of more than 4 kW.

12. The boat drive of claim 1, wherein the control device and the unlocking device are configured such that the control device remains ineffective if the unlocking device is not operated in direct conjunction with the control device.

13. The boat of claim 8, wherein the wherein the control device and the unlocking device are configured such that can only be unlocked from the neutral position only if at the same time the unlocking device is actuated.

14. The boat of claim 1, wherein the at least one of the control device and the unlocking device are configured such that, after the control device has been brought into the operating position, it holds the unlocking device mechanically in the unlocked position.

15. The boat of claim 1, wherein the control device and the unlocking device are configured such that the operation of the unlocking device must continue only until the control device has been brought into the operating position.

16. The boat of claim 1, further comprising a timing element, wherein the control device, the unlocking device, and the timing element are configured such that the timing element requires the simultaneous operation of the control device and the unlocking device for a certain period in order to set the propeller in rotation and maintain the rotary movement, wherein after expiry of the period it is no longer necessary to continue to operate the unlocking device.

17. The boat of claim 2, wherein the control device and the unlocking device are configured such that, for changing the direction of rotation of the propeller, when the control device passes through the neutral position, the unlocking device and the control device have to be operated simultaneously again.

* * * * *